US006533712B1

(12) United States Patent
Miller et al.

(10) Patent No.: US 6,533,712 B1
(45) Date of Patent: Mar. 18, 2003

(54) CENTRIFUGE HOUSING WITH OIL FILL PORT

(75) Inventors: Paul D. Miller, Cookeville, TN (US); Hendrik Amirkhanian, Cookeville, TN (US); Peter K. Herman, Cookeville, TN (US)

(73) Assignee: Fleetguard, Inc., Nashville, TN (US)

( * ) Notice: Subject to any disclaimer, the term of this patent is extended or adjusted under 35 U.S.C. 154(b) by 0 days.

(21) Appl. No.: 09/690,260

(22) Filed: Oct. 17, 2000

(51) Int. Cl.[7] ..... B04B 7/02; B04B 9/06

(52) U.S. Cl. ..... 494/60; 494/49

(58) Field of Search ..... 494/24, 36, 43, 494/49, 60, 64, 65, 68, 70, 901; 210/168, 171, 232, 354, 360.1, 380.1, 416.5; 184/6.24

(56) References Cited

U.S. PATENT DOCUMENTS

| | | | | |
|---|---|---|---|---|
| 702,795 | A | * | 6/1902 | Holmes |
| 2,755,017 | A | * | 7/1956 | Kyselka et al. |
| 2,799,448 | A | * | 7/1957 | Lee |
| 3,784,092 | A | | 1/1974 | Gibson |
| 3,879,294 | A | * | 4/1975 | Ellis et al. |
| 3,967,777 | A | * | 7/1976 | Canevari |
| 4,284,504 | A | | 8/1981 | Alexander et al. |
| 4,288,030 | A | * | 9/1981 | Beazley et al. |
| 4,346,009 | A | | 8/1982 | Alexander et al. |
| 4,400,167 | A | | 8/1983 | Beazley et al. ..... 494/49 |
| 4,498,898 | A | | 2/1985 | Haggett ..... 494/49 |
| 4,534,860 | A | | 8/1985 | Budzich |
| 4,557,831 | A | | 12/1985 | Lindsay et al. |
| 4,787,975 | A | * | 11/1988 | Purvey |
| 5,096,581 | A | | 3/1992 | Purvey |
| 5,180,358 | A | * | 1/1993 | Pace |
| 5,484,383 | A | * | 1/1996 | Fitch, Jr. et al. |
| 5,575,912 | A | | 11/1996 | Herman |
| 5,637,217 | A | | 6/1997 | Herman et al. |
| 5,683,342 | A | | 11/1997 | McNair ..... 494/49 |
| 5,795,477 | A | | 8/1998 | Herman et al. |
| 5,814,214 | A | | 9/1998 | Chun |
| 5,888,383 | A | | 3/1999 | Cox |
| 5,904,841 | A | * | 5/1999 | Penny |
| 6,017,300 | A | | 1/2000 | Herman ..... 494/49 |
| 6,019,717 | A | * | 2/2000 | Herman |
| 6,196,962 | B1 | * | 3/2001 | Purvey et al. |

FOREIGN PATENT DOCUMENTS

| | | | |
|---|---|---|---|
| GB | 6687666 | * | 3/1952 |

OTHER PUBLICATIONS

"You've Got the POWER . . . We've Got The PROTECTION!", Fleetguard–Nelson Brochure, 2000.

* cited by examiner

*Primary Examiner*—Charles E. Cooley
(74) *Attorney, Agent, or Firm*—Woodard, Emhardt, Naughton, Moriarty & McNett LLP

(57) ABSTRACT

A centrifuge for processing a flow of oil in order to remove particulate matter includes a mounting base defining a drain passageway, a drain conduit connected to the mounting base, a unitary housing connected to the mounting base, and a cone-stack subassembly which is positioned in and cooperates with the unitary housing. The mounting base is constructed and arranged to mount directly to a portion of a vehicle engine (or other equipment) and the drain conduit provides a return path to sump for oil from a remote engine (or equipment) location. The unitary housing is an injection molded plastic component including both a main body portion and an integral oil fill port. The oil fill port is substantially cylindrical with a longitudinal axis which is parallel to the axis of rotation for the rotor portion of the centrifuge.

4 Claims, 14 Drawing Sheets

CENTRIFUGE HOUSING WITH OIL FILL PORT

BACKGROUND OF THE INVENTION

The present invention relates in general to the design of a centrifugal separator for oil as part of a vehicle lube system. More particularly, the present invention relates to the design of a centrifuge housing which incorporates an oil fill port, allowing oil to be added to the lube system by way of the oil fill port. This integral construction provides greater design efficiency and enables the option of incorporating other features. While the present invention is described in the context of a vehicle lube system, the same concept and structure is able to be used for the lube system of other equipment. In order to realize the benefits of the present invention, with such "other" equipment, the centrifuge assembly should mount to the equipment and be constructed and arranged so as to drain directly to a sump.

Typically, in prior art engine designs utilizing a centrifuge, the centrifuge housing is positioned in a different location from the oil fill port of the engine and is spaced apart from the oil fill tube. As such, the engine must be designed first to accommodate the mounting of the centrifuge and secondly to provide space and the necessary structural compatibility and interface for the oil fill tube. These types of earlier designs represent a less efficient construction, as compared to the present invention, due to the need to provide a separate (and independent) path for the engine oil fill. With these prior art designs, engine or equipment space needs to be provided for this separate path as well as fluid couplings and these contribute to the overall inefficiency of the design.

Prior to the present invention, an attempt was made to overcome some of these centrifuge/engine inefficiencies by adding an oil fill tube (port) into a centrifuge housing. In this earlier design, the centrifuge housing is a drawn metal enclosure and, by means of a series of fabrication steps, a separate oil fill tube is attached to the housing. In order to fabricate this prior art design, the oil fill tube is provided as a separate component which is then welded to the centrifuge housing. In order to accommodate this combination, a clearance hole needs to be machined into the housing, and these machining and fabrication steps add to the cost and complexity of this prior art design.

The present invention provides a design improvement to this prior art centrifuge by integrating the oil fill port into the centrifuge housing as a unitary, injection molded, plastic component. Alternatively, the unitary centrifuge housing and integrated oil fill tube may be a metal casting according to the present invention. By locating the oil fill port at the top center location of the housing or optionally offset to one side, it is possible to simplify the mold design and simplify the fabrication of this unitary centrifuge housing/port combination and the corresponding centrifuge. The incorporation of the oil fill port in the manner described allows filling oil directly through the centrifuge housing in those applications where the centrifuge is engine (or equipment) mounted and where the centrifuge drains directly to sump. This integration of the two parts (housing and oil fill port) into one (unitary), molded plastic (or cast metal) unit eliminates the need for any secondary path for filling oil into the sump by way of a traditional port or fill path.

In order to simplify the fabrication steps and the mold design for this unitary combination, it is important to locate the longitudinal, centerline axis of the oil fill port coplanar with an axial, centerline plane of the centrifuge housing and to orient the longitudinal axis of the oil fill port parallel to the longitudinal axis of the housing. The longitudinal (centerline) axis of the housing coincides with the axis of rotation for the centrifuge.

SUMMARY OF THE INVENTION

A centrifuge for processing a flow of oil according to one embodiment of the present invention comprises a mounting base defining a drain passageway, a unitary housing connected to the mounting base and including a main body and an integral oil fill port, and centrifugal separation means for removing particulate matter from the flow of oil, the centrifugal separation means being positioned in and cooperating with the unitary housing.

One object of the present invention is to provide an improved centrifuge for processing a flow of oil.

Another object of the present invention is to provide an improved unitary housing for a centrifuge which incorporates an integral oil fill port.

Related objects and advantages of the present invention will be apparent from the following description.

DESCRIPTION OF THE PREFERRED EMBODIMENTS

Figure 1:
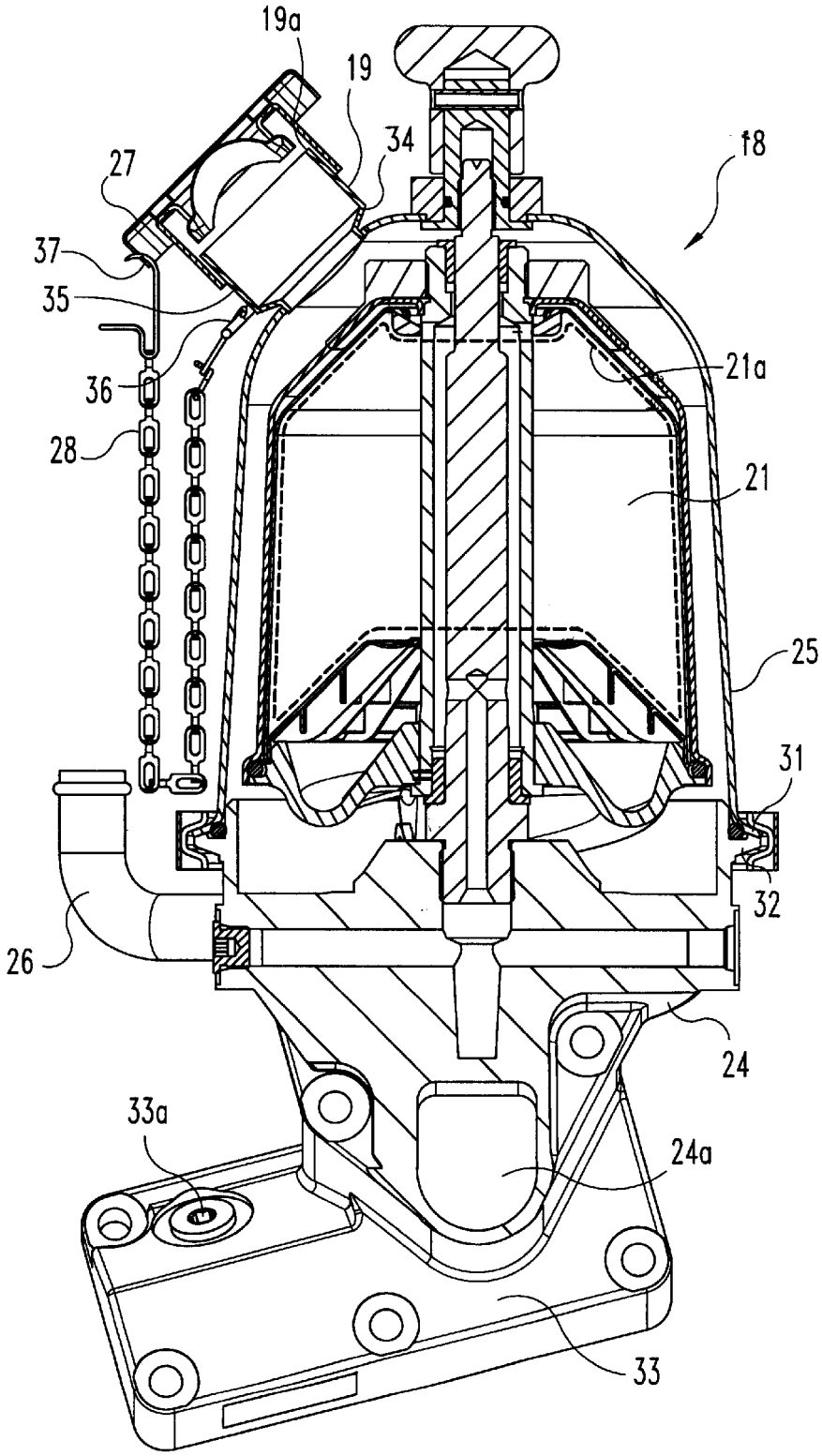
Fig. 1 (PRIOR ART)
FIG. 1 is a front, perspective view, in partial section, of a prior art centrifuge including an oil fill port.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
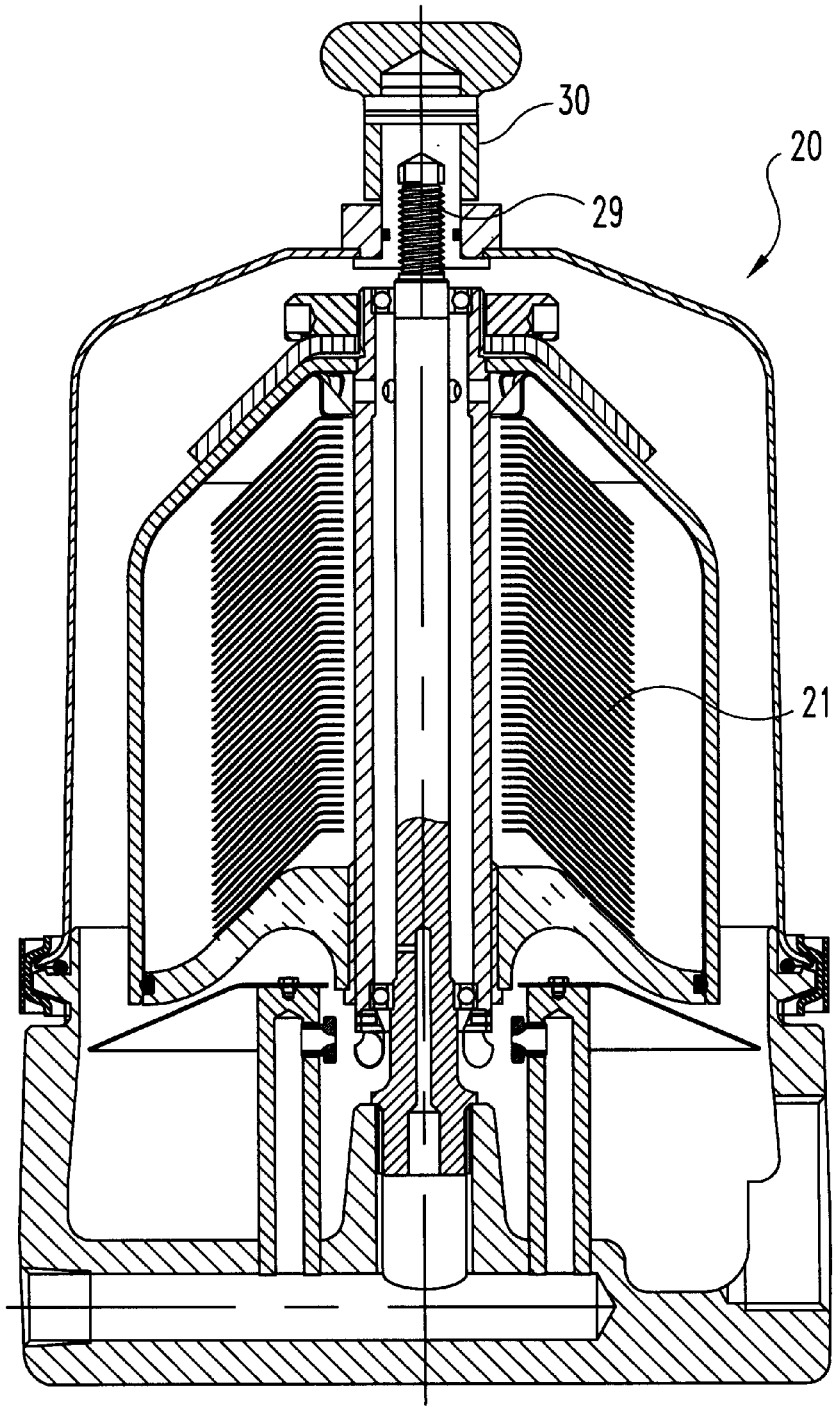
Fig. 2 (PRIOR ART)
FIG. 2 is a front elevational view, in full section, of a centrifuge with a cone stack subassembly providing centrifuge separation means for the FIG. 2 centrifuge.

Referring to FIGS. 1 and 2, there is illustrated a prior art centrifuge 18 with an oil fill port 19 (FIG. 1) and a prior art centrifuge 20 with a cone-stack subassembly 21 for separating particulate matter from a flow of oil (FIG. 2). FIG. 2 generally coincides with the centrifuge structure of U.S. Pat. No. 6,017,300. The disclosures of U.S. Pat. Nos. 5,575,912; 5,637,217; and 5,795,477 provide similar examples of cone-stack technology. U.S. Pat. No. 5,575,912, issued on Nov. 19, 1996 to Herman, et al., is expressly incorporated by reference herein for its entire disclosure. U.S. Pat. No. 5,637,217, issued on Jun. 10, 1997 to Hernan et al., is expressly incorporated by reference herein for its entire disclosure. U.S. Pat. No. 5,795,477, issued on Aug. 18, 1998 to Herman, et al., is expressly incorporated by reference herein for its entire disclosure. U.S. Pat. No. 6,017,300, issued on Jan. 25, 2000 to Herman, is expressly incorporated by reference herein for its entire disclosure. In one embodiment of the present invention, the FIG. 1 centrifuge 18 incorporates the cone-stack technology of FIG. 2 as indicated by the broken line outline 21*a* in FIG. 1 which denotes the location for the cone-stack subassembly 21 within the centrifuge 18. The details of centrifuge 18 are described herein and further illustrated in the printed publication of Fleetguard-Nelson entitled "You've Got The POWER . . . We've Got The PROTECTION!"(publication part number 15086).

In other embodiments of the present invention, the cone-stack subassembly 21 is replaced by other separation technology or eliminated altogether. The use of the broken line outline 21*a* in FIG. 1 is intended to illustrate these options.

Referring to FIG. 1, centrifuge 18 includes a mounting base 24, drawn metal housing 25, oil fill (tube) port 19, drain conduit 26, cap 27, and chain 28. The cap 27 is constructed and arranged to be secured onto the oil fill port in order to close the open end 19*a*. The hollow interior of the housing 25 receives the cone-stack subassembly 21 of centrifuge 20. The location for subassembly 21 is outlined by broken line 21*a*. The centered, threaded rod 29 of FIG. 2 in combination with the securing nut 30 is used primarily to draw the housing down onto the base. This same approach is used with the FIG. 1 centrifuge. Additionally, the lower edge 31 of the housing 25 is clamped to the upper portion 32 of the mounting base 24 by the surrounding band clamp. Support plate 33 which is part of mounting base 24 is constructed and arranged to attach directly to a portion of the engine. The drain conduit 26 is flow coupled at one end to mounting base 24 and at the free end to another portion of the engine which provides a flow of oil to be returned to sump. This conduit 26 can also function as an air vent. The mounting base 24 is constructed and arranged with an oil-return passageway 24*a* which is defined by the casting which creates mounting base 24. A connecting and cooperating passageway is defined by support plate 33 for return of centrifuge oil to sump. A variety of oil exit paths and designs are contemplated by the present invention since none are actually influenced by the molded, unitary construction of the centrifuge housing according to the present invention. A plugged clearance hole 33*a* is provided as a means of incorporating an oil level indicator (i.e., dipstick) in those situations and mounting arrangements when hole 33*a* would be located over the sump or other measuring reservoir. Use of this hole 33*a* for this purpose was never previously practiced nor taught.

In a typical engine (or equipment) application, some type of oil-fill option is provided in order to periodically add oil in order to make up for oil usage or loss and thus maintain a safe operating level for the oil. What is usually done for the lube systems of engines and similar equipment is to create a separate oil fill path or passageway. Not only does this require clearance space within the engine, but specific flow couplings and connections need to be provided, adding to the overall cost and, to some extent, an inefficiency in the design. By adding the oil fill port 19 to the centrifuge housing 25, the need for a "separate" oil fill path or passageway is eliminated. In the context of this description, "separate" means both a separate component or set of components used to create the oil fill path or passageway as well as being separate from the centrifuge location, i.e., spaced-apart from the centrifuge location.

The centrifuge structure of FIG. 1 incorporates a separate oil fill port 19 into a drawn metal housing 25. In order to do so, the drawn metal housing must first be machined with a suitable clearance hole 34 for receipt of the conduit 35 that creates the oil fill port 19. The clearance hole 34 location is in the curved, upper portion of the drawn metal housing. The generally cylindrical conduit 35 is then welded into position around the clearance hole so as to establish a sealed interface at that location. Due to this welding step, the conduit 35 may be placed in the clearance hole 34 or simply around the clearance hole 34, noting that the welding will not only establish a sealed interface, but also provide the structural strength necessary to maintain the oil fill port 19 in position. The welding step is facilitated by orienting the conduit 35 in a direction which is substantially normal to the tangential plane passing through the geometric center of the clearance hole 34.

Conduit 35 includes a connection loop or eyelet 36 for hooking one end of chain 28. The opposite end of chain 28 is hooked onto an eyelet-like portion 37 on cap 27 so as to tether the cap to the housing. In this manner, whenever the cap is removed for adding oil into the oil fill port, there is no risk of the cap being dropped, lost, or otherwise misplaced.

While centrifuge 18 provides advantages to engine designs with a separate oil fill path, namely the elimination of the connections and the need for added clearance space in the engine, the design of centrifuge 18 is not optimized. There are ways to improve upon the design of centrifuge 18 and these improvements are provided by the present invention as detailed in FIGS. 3–13 and as described hereinafter. There are two embodiments of the present invention which are disclosed. The first embodiment is illustrated in FIGS. 3–7B. The second embodiment is illustrated in FIGS. 8–12A. FIG. 13 illustrates a closing cap option which is suitable for both embodiments of the present invention. Both embodiments of the present invention combine the centrifuge housing and the oil fill port into a unitary, molded plastic component. This design reduces the number of separate component parts and the labor associated with fabricating conduit 35 and welding this conduit to housing 25 in order to create the oil fill port 19. The use of a unitary molded plastic housing also reduces the weight of the housing as compared to the drawn metal housing of FIG. 1.

With reference to FIGS. 3–7A, there is illustrated a first embodiment of the present invention in the form of unitary centrifuge housing 50. It is to be understood that housing 50 is regarded as being a direct substitute or replacement for the combination of drawn metal housing 25 and oil fill port 19, as illustrated in FIG. 1. The remainder of the FIG. 1 structure, including the cone-stack subassembly 21 detailed as part of the FIG. 2 centrifuge, remains virtually unchanged. The present invention is directed to an improvement in the centrifuge housing by making the actual housing and the oil fill port a unitary molded plastic component. This same direct substitution of the new and improved housing for the drawn metal housing and welded oil fill port of FIG. 1 also applies to the second embodiment of the present invention as detailed by FIGS. 8–12A.

Figure 4:
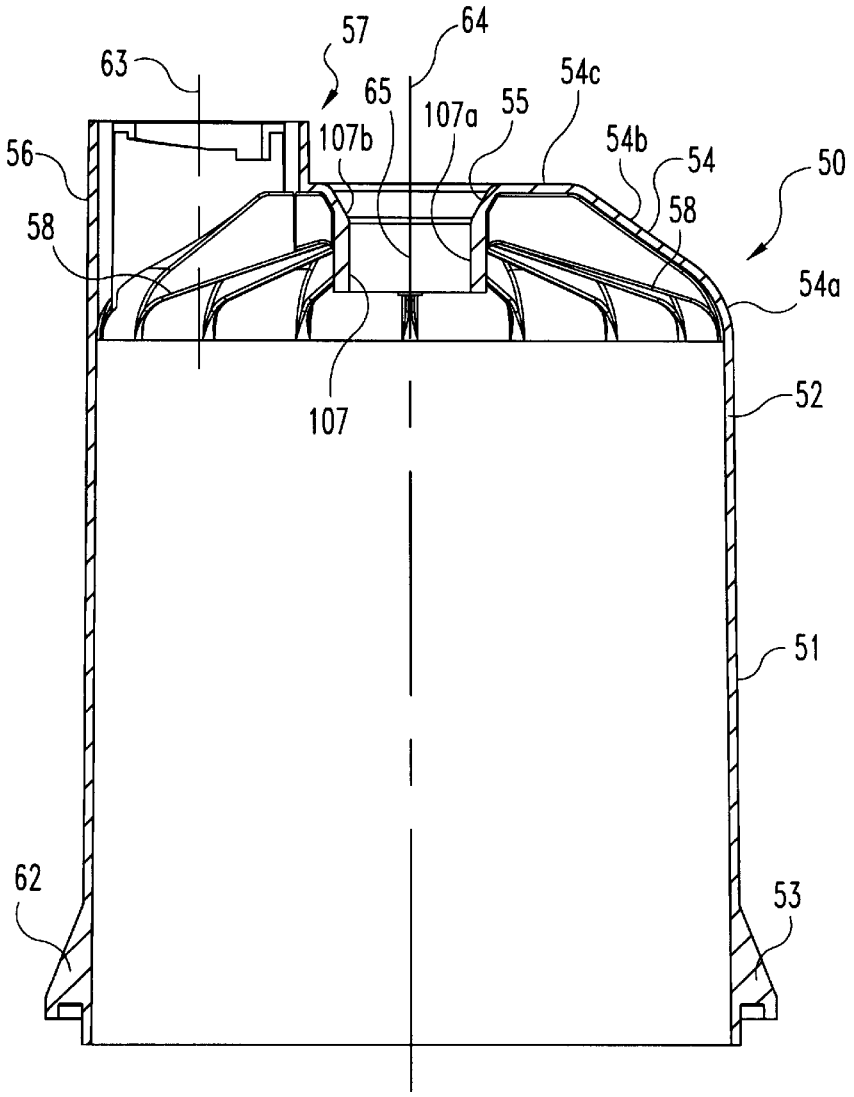
FIG. 4 is a side elevational view, in full section, of the FIG. 3 housing as viewed along line 4—4 in FIG. 3.

Housing 50 is injection molded out of Dupont "ZYTEL" 70G30L or an equivalent synthetic material. Housing 50 includes a hollow main body portion 51 with a generally cylindrical sidewall 52, ribbed base portion 53, top portion 54, and centered aperture 55 which is used for the rotor shaft of the centrifuge which will be assembled into the housing. In the illustrated embodiment, the centrifuge technology includes the cone-stack subassembly 21. Integrally and unitarily molded into curved top portion 54 is cylindrical conduit 56 which creates an oil fill port 57. Top potion 54 may be smoothly curved or segmented as illustrated in FIG. 4. With reference to FIG. 4, it will be seen that top portion 54 includes a curved or radiused comer 54*a*, a frustoconical section 54*b*, and a horizontal section 54*c*.

Figure 3:
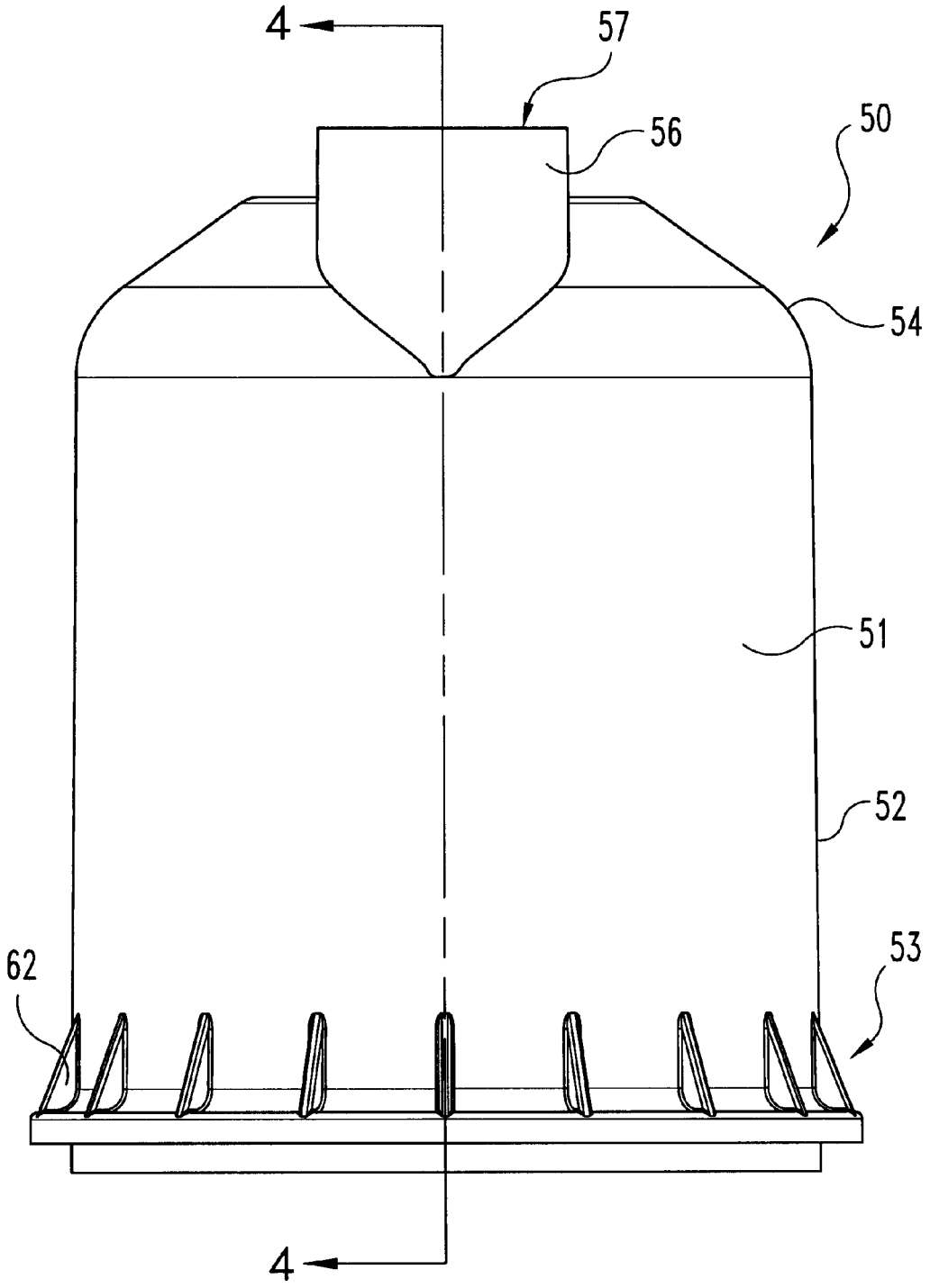
FIG. 3 is a front elevational view of a unitary centrifuge housing according to a typical embodiment of the present invention.
Figure 4A:
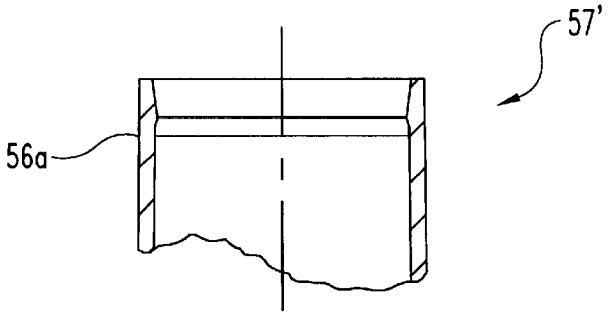
FIG. 4A is a partial, side elevational view, in full section, of an alternative conduit design according to the present invention.
Figure 5:
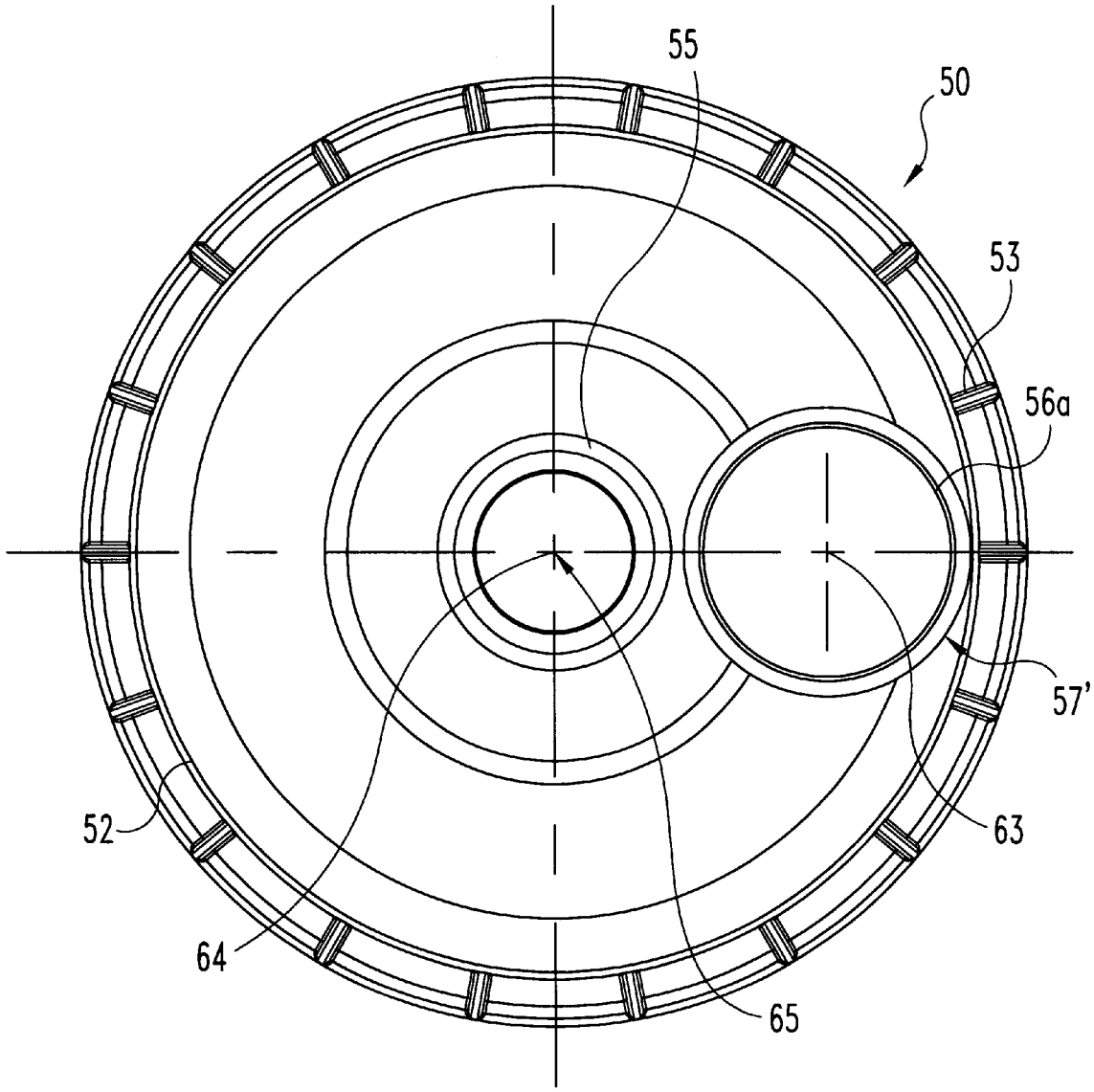
FIG. 5 is a top plan view of the FIG. 3 housing.
Figure 6:
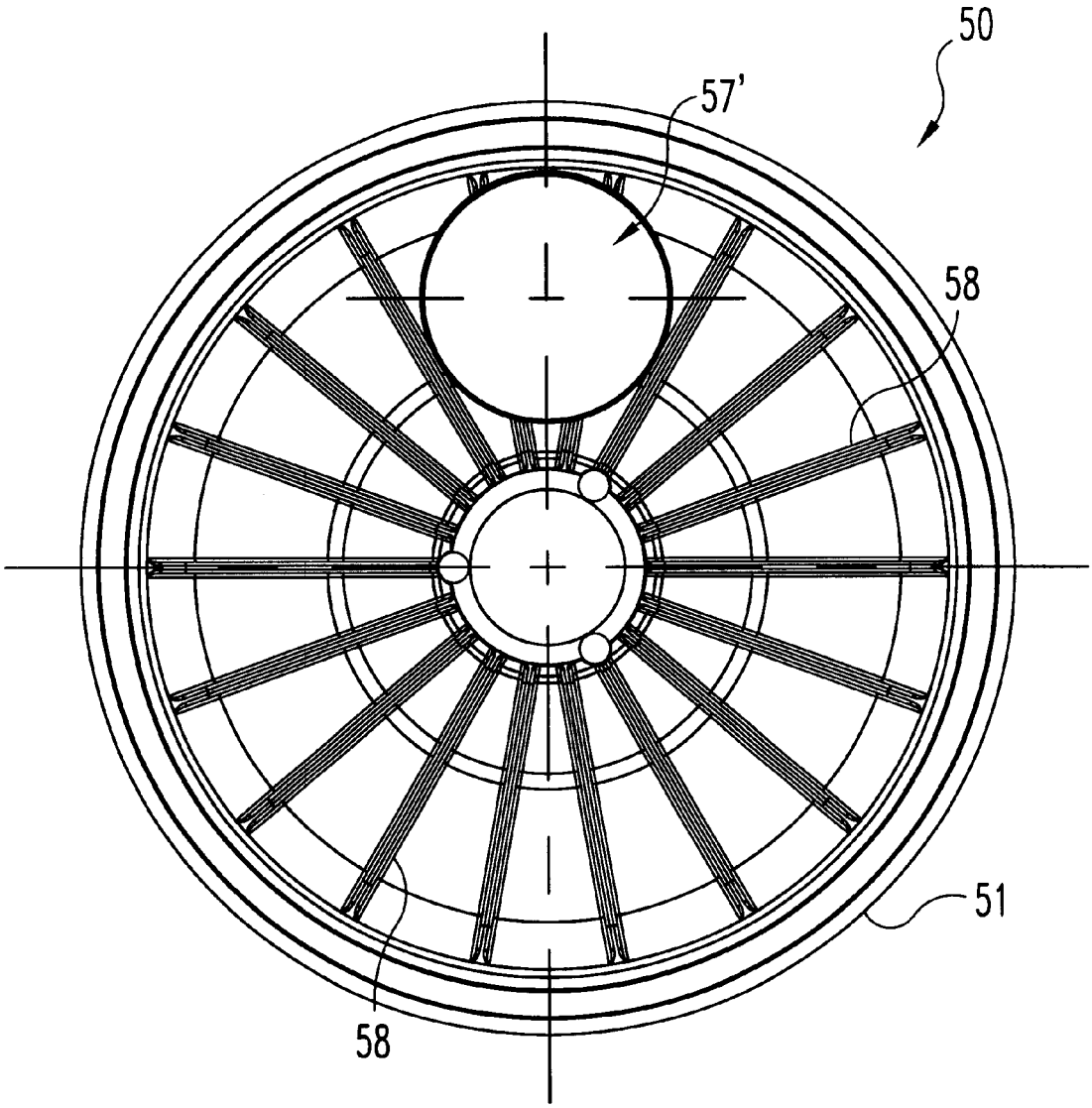
FIG. 6 is a bottom plan view of the FIG. 3 housing.

An alternate style of cylindrical conduit 56*a* is illustrated in FIG. 4A. For added drawing clarity and simplicity, the FIG. 4A style of conduit has been used in the top plan view of FIG. 5 and the bottom plan view of FIG. 6. For this reason, the oil fill port 57 of FIGS. 3 and 4 becomes oil fill port 57' in FIGS. 5 and 6. It should be understood that oil fill ports 57 and 57' are otherwise identical except for the style of closing cap which would be used, see FIGS. 7 and 13.

The detailed section view of FIG. 4 shows the unitary construction of housing 50 including, as part of that unitary construction, aperture 55, oil fill port 57 (or 57'), and the radiating pattern of flow directing ribs or vanes 58. There are a total of eighteen (18) vanes 58 equally spaced apart as best illustrated in the bottom plan view of FIG. 6. Two of the eighteen vanes 58 are only partial in form due to the incorporation of conduit 56 and the resulting creation of the oil fill port 57. The ribbed base portion 53 is constructed and arranged to be attached to mounting base 24 in the same manner as provided for in FIGS. 1 and 2. The same type of centered, threaded rod and nut combination is used to draw the housing down onto the base. A band clamp is not used. The individual ribs 62, each of which is generally triangular in shape, are located at equal twenty degree spacing and there are eighteen ribs total. These ribs provide additional strength to the base of the housing. Additional strength is helpful in this location due to the molded plastic construction of housing 50. With a drawn metal housing the same type of strength issues normally do not exist. The inclusion of the ribs makes it awkward to try and use a band clamp. However, an annular gasket is used beneath the base portion 53 and above the mounting base 24 to enhance this sealed interface. The top plan view of FIG. 5 details the location and spacing of ribs 62 and importantly the location and orientation of the oil fill port 57 relative to the remainder of housing 50.

The addition of ribs 62 around the circumference of the base portion 53 and their shape have to be considered when designing the mold and the parting line location on the housing. As will be described hereinafter, the orientation of the oil fill port 57 relative to the axis of rotation, such that the longitudinal centerline of the oil fill port is parallel to that axis, enables a parting line location through or below the ribs 62 which is required to be able to mold (or cast) the unitary housing. This parting line is perpendicular to the axis of rotation 64. There is accordingly a cooperative relationship between having a molded, unitary design, the use of strengthening ribs, the required parting line location and the need to orient the oil fill port so that its longitudinal axis is parallel to the axis of rotation and parallel to the direction of movement of the mold halves as they separate away from the parting line.

As would be understood, due to its generally circular or cylindrical form, housing 50 has a longitudinal axis which is represented by longitudinal axis line 64. This line also represents the axis of rotation for the rotor portion of the assembled centrifuge. Any diametrical cutting plane for housing 50 would thus pass through and be coplanar with longitudinal axis line 64. The longitudinal axis 63 of the oil fill port 57 is centered on the longitudinal axis line 64 as is center aperture 55. In fact, the longitudinal centerline 65 of aperture 55 is coincident with longitudinal axis line 64 for housing 50. The longitudinal axis line 63 for the oil fill port is not only coplanar with the longitudinal axis line 64, but importantly line 63 is parallel with line 64 (and with line 65). The axis centerline location and the parallel orientation of the oil fill port are important for the ability to mold the housing as a unitary member. These structural features and relationships are also important to the simplicity of the resultant housing as well as the simplicity of the mold or die arrangement which is used to create unitary housing 50.

Figure 7:
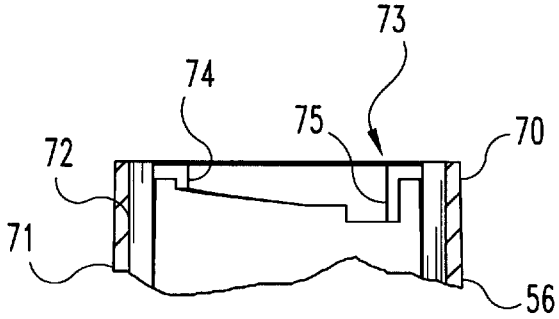
FIG. 7 is a partial, enlarged detail of the oil fill port of the FIG. 4 housing.
Figure 7A:
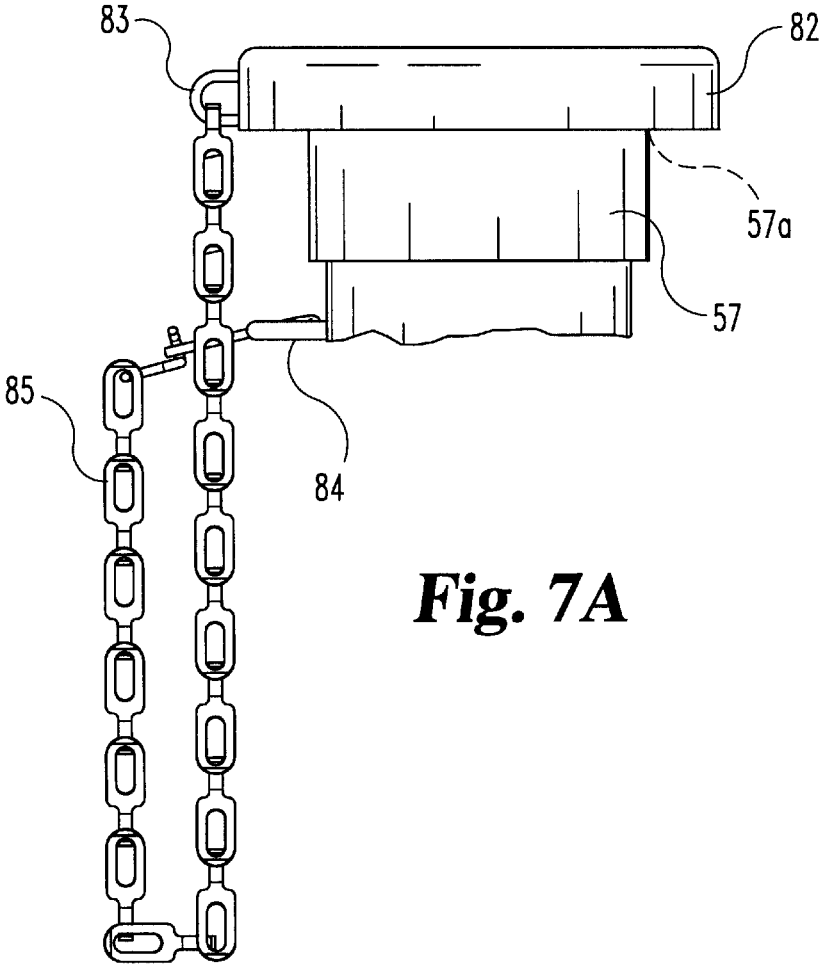
FIG. 7A is a side elevational view of a closing cap as assembled to the oil fill port of the FIG. 3 housing.

With reference to FIGS. 7 and 7A, the details of the upper edge portion 70 of conduit 56 are illustrated. The outer surface 71 of sidewall 72 is substantially cylindrical as would be permitted for the internal bayonet-type connection 73 illustrated by offset portions 74 and 75. Another option would be to internally thread conduit 56 and use a closing cap 82 with external threads and an enlarged head portion to fit over and seal against the open end 57*a* of the oil fill port 57. The attachment of cap 82 to open end 57*a* of oil fill port 57 is illustrated in FIG. 7A. If a threaded connection is selected, the outer appearance would still look quite similar to what is illustrated in FIG. 7A. A still further option of a flexible rubber plug is illustrated in FIG. 13. The open-loop eyelets 83 and 84 permit a chain 85 or similar tether to be connected so as to retain the cap 82 once removed from open end 57*a*. This helps to ensure that the cap will not be dropped, misplaced, or otherwise lost. The FIG. 7A illustration with respect to the eyelets 83 and 84 and chain 85 will be visually the same whether using a bayonet-type connection or a threaded fit between the cap 82 and the open end 57*a*.

While the centerline location and parallel orientation for oil fill port 57 has various advantages relative to the simplicity of construction and the simplicity of the mold, there is another embodiment for the oil fill port according to the present invention which incorporates these same improvements and advantages. With reference to FIGS. 8–12A, this second embodiment is illustrated. A review of FIGS. 8–12A compared to FIGS. 37A will show that the only differences in construction and arrangement of housing 50, as compared to housing 100 (see FIG. 8), is the location of the oil fill port, item 57 in FIGS. 3–7A and item 101 in FIGS. 8–12A. While the changes in location and design of the oil fill port 101 cause other design changes to be made to the main body portion 102 of housing 100, the two housings are otherwise virtually identical.

Figure 8:
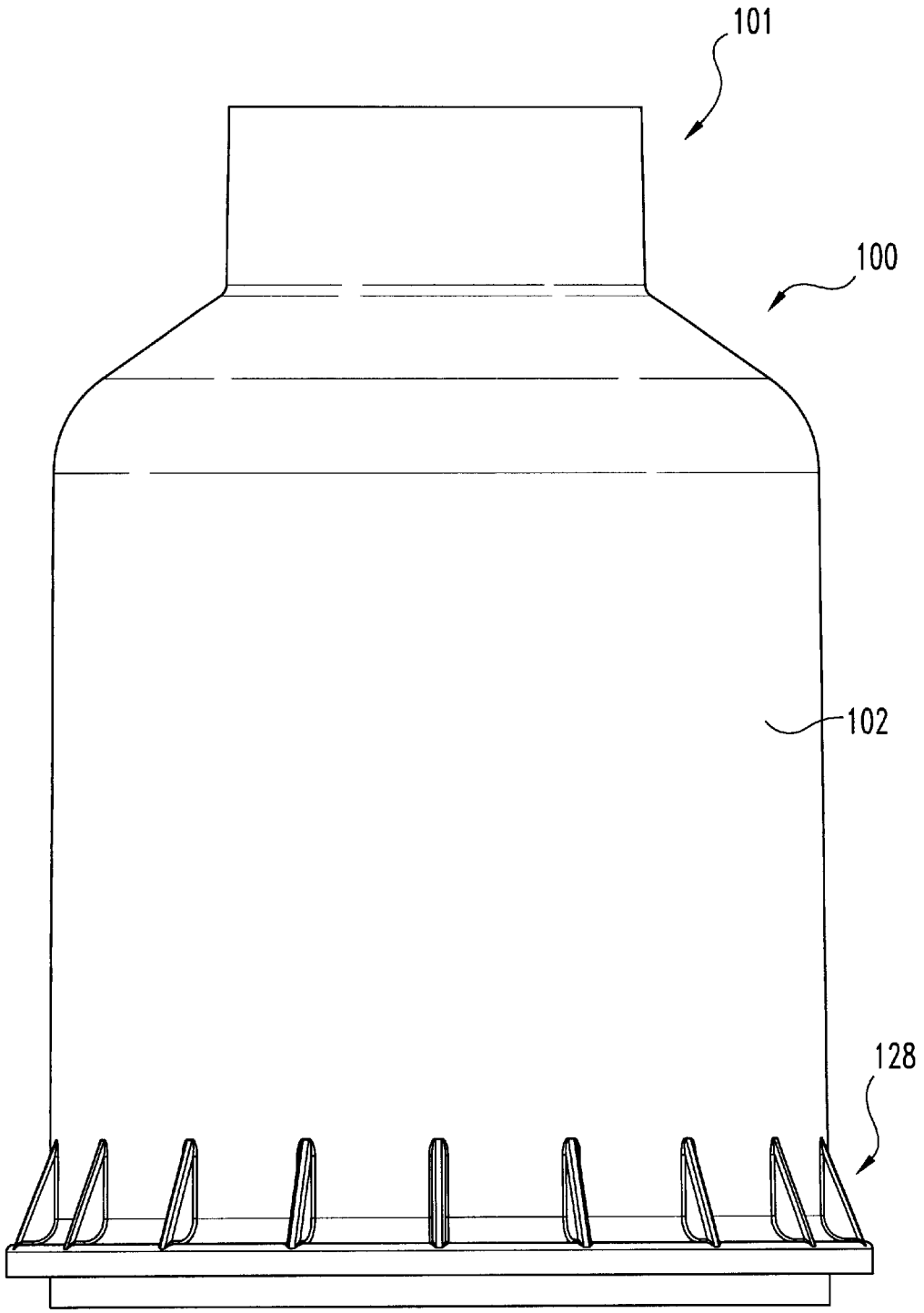
FIG. 8 is a front elevational view of a unitary centrifuge housing according to another embodiment of the present invention.

To illustrate this previous point, FIG. 3 should be compared to FIG. 8. These two illustrations are identical except that the oil fill port 57 is eliminated from the curved, top section of the main body portion 51 (in FIG. 3) and except for the slight modifications to the centered aperture 103 in order to incorporate and be compatible with a concentric oil fill port 101 (see FIG. 9). Corresponding differences are found in a comparison of FIGS. 4 and 9, FIGS. 5 and 10, FIGS. 6 and 11, and FIGS. 7 and 12.

Figure 9:
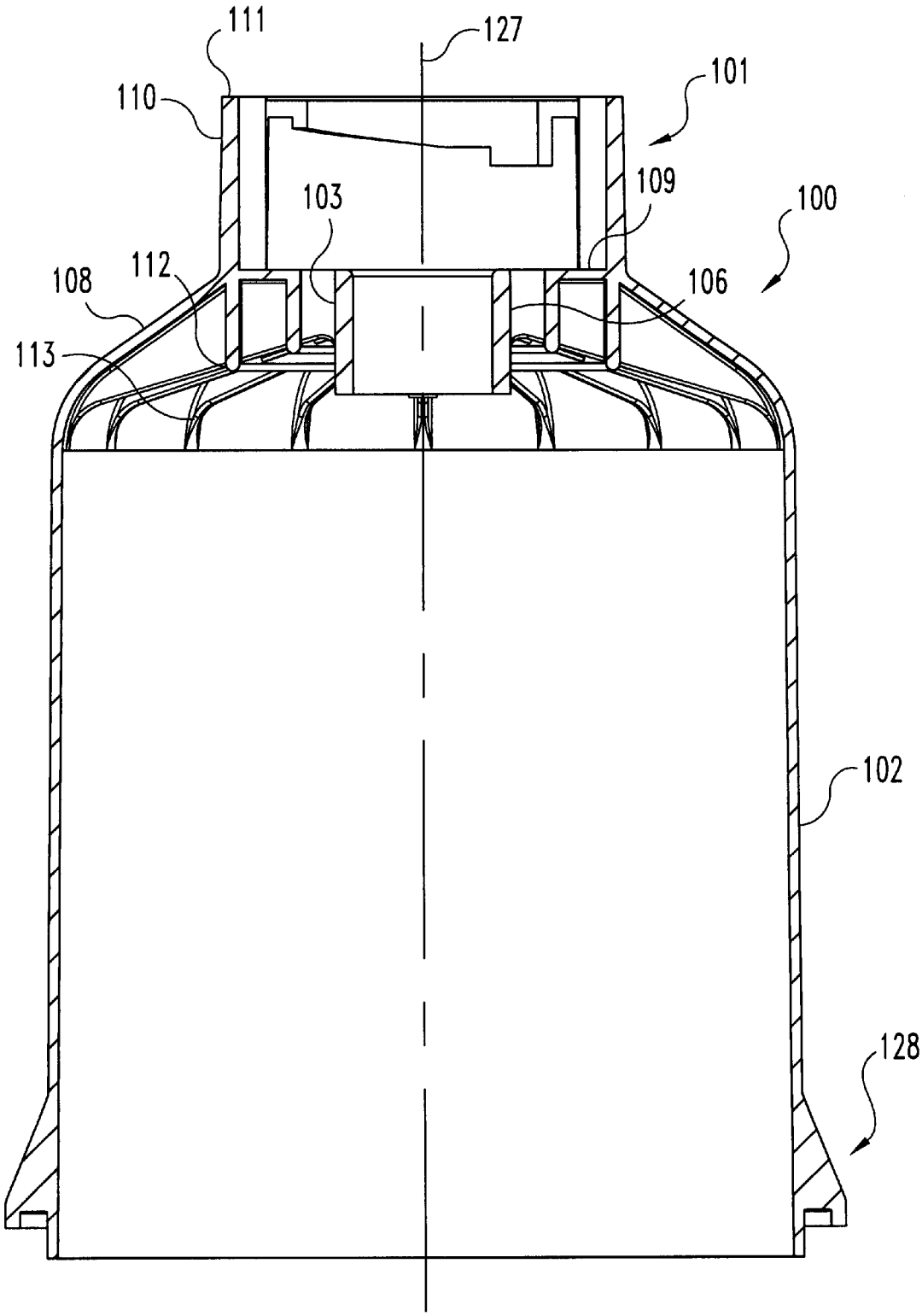
FIG. 9 is a side elevational view, in full section, of the FIG. 8 housing as viewed along line 9—9 in FIG. 10.
Figure 12:
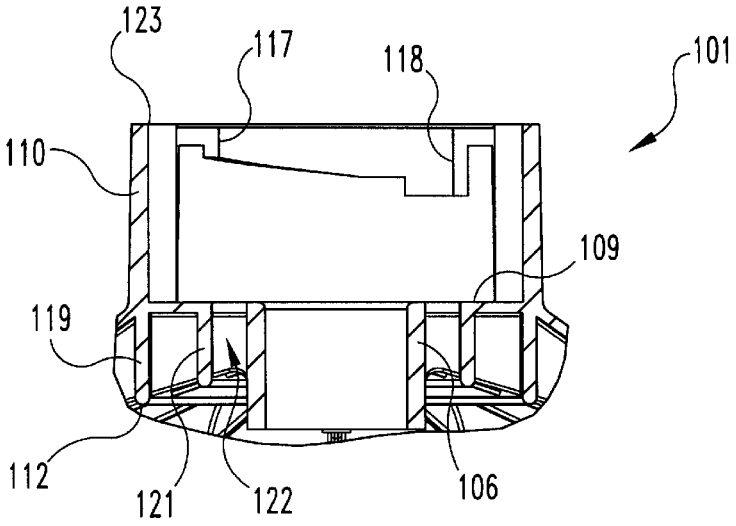
FIG. 12 is a side elevational view in full section, of the centered oil fill port of the FIG. 9 housing as viewed along line 12—12 in FIG. 10.

With continued reference to FIGS. 8–12A, the details of housing 100 are illustrated. Housing 100 includes oil fill port 101, main body portion 102, and centered aperture 103. As previously described, the oil fill port 101 is concentric with the centered aperture 103. With specific reference to FIG. 9, it will be seen that the centered aperture 103 is substantially cylindrical with a defining wall portion 106 which is cylindrical throughout its axial length, as contrasted to wall portion 107 (see FIG. 4) which defines centered aperture 55. Wall portion 107 has a cylindrical portion 107*a* and an upper frustoconical portion 107*b* which blends into horizontal section 54*c* of top portion 54. Wall portion 106 extends to the plane of the upper section 109 of the curved, top portion 108. Section 109 corresponds, roughly, to horizontal section 54*c*. However, upper section 109 is segmented into four regions 109*a*, 109*b*, 109*c*, and 109*d* (see FIG. 10A). Regions 109*a* and 109*b* are solid or closed as seen in FIGS. 9 and 12. Regions 109*c* and 109*d* are open and are located below those forms or portions that form the bayonet-style connection for the closing cap.

Figure 10:
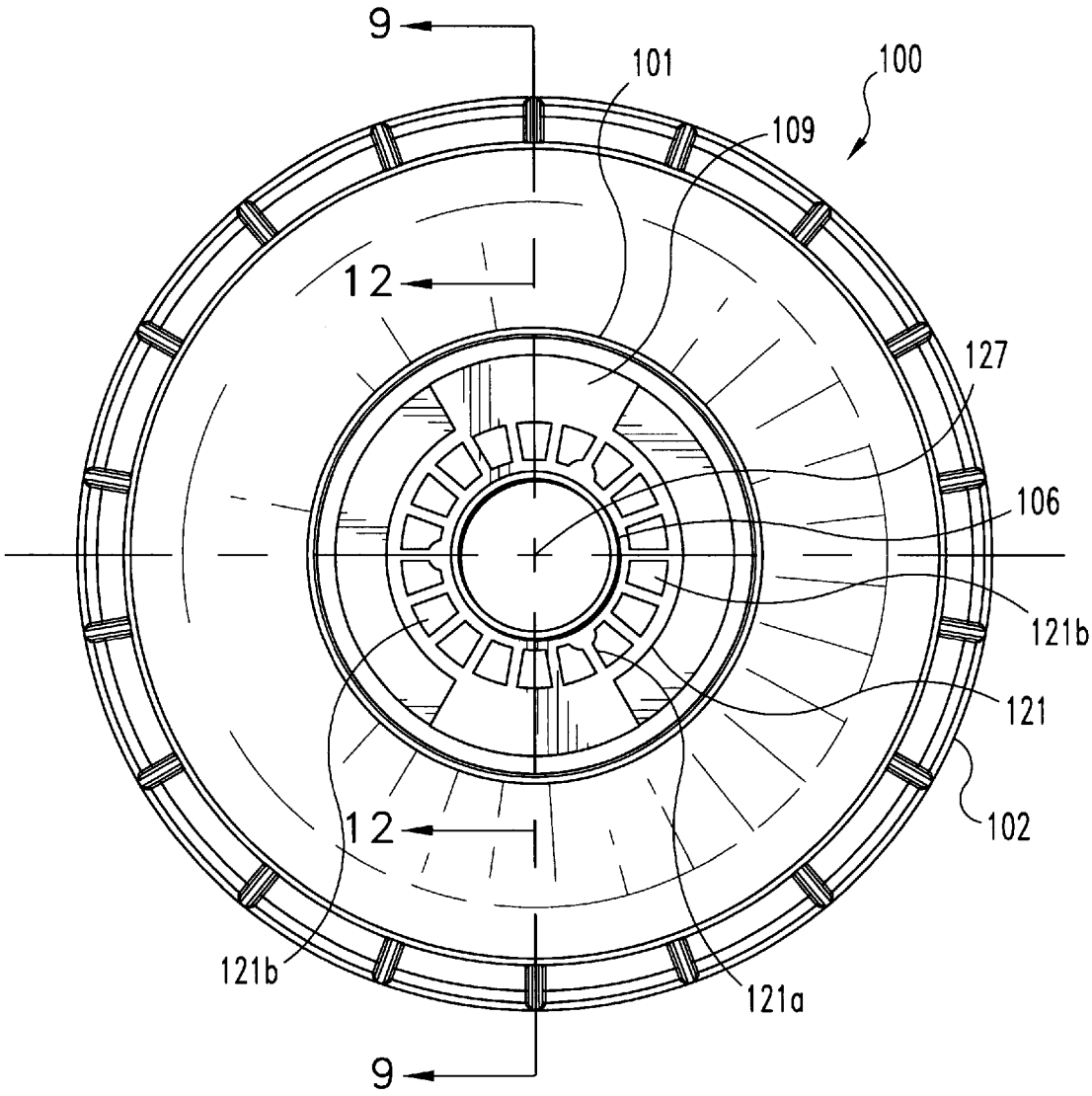
FIG. 10 is a top plan view of the FIG. 8 housing.
Figure 10A:
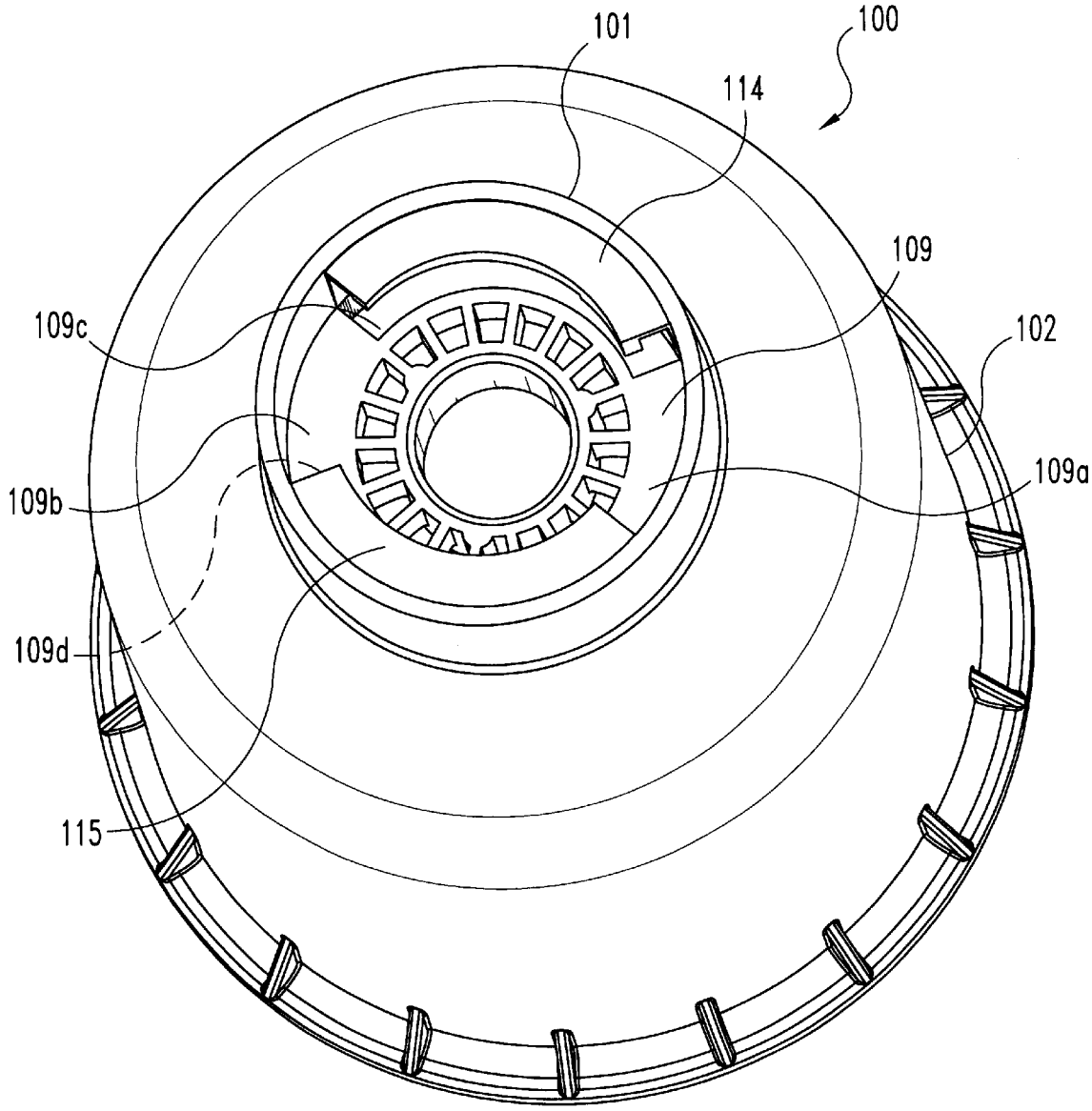
FIG. 10A is a top perspective view of the FIG. 8 housing.
Figure 11:
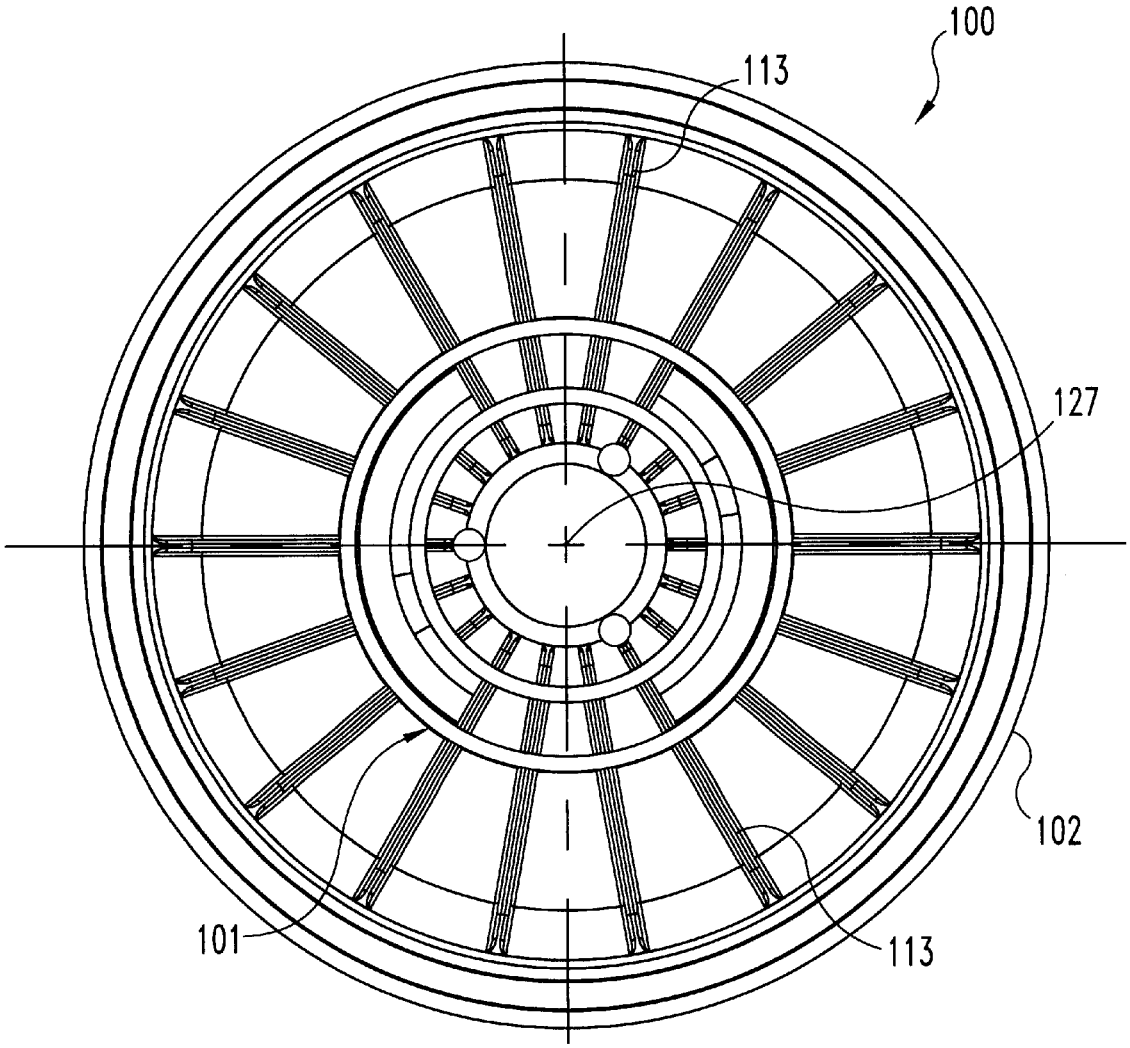
FIG. 11 is a bottom plan view of the FIG. 8 housing.

The upper section 109 of the top portion 108 is substantially circular (albeit segmented, as described) and, from its outer edge, the substantially cylindrical wall 110, which defines the oil fill port 101, extends both upwardly to circular edge 111 and downwardly to lower edge 112. Lower edge 112, which is also circular, is located adjacent the vanes 113. Oil fill port 101 is constructed and arranged with the bayonet-style coupling for the closing cap 116 (see FIGS. 12 and 12A) and the structural features of one half of this bayonet coupling are illustrated by line forms 117 and 118 in FIG. 12. The complete component forms which create the bayonet-style coupling are illustrated in FIG. 10A as members 114 and 115.

At the outer edge of section 109, wall portion 110 extends downwardly into section 119. At the inner edge 109*a* of section 109, the unitary housing 100 includes depending cylindrical wall 121. Wall sections 119 and 121 are each substantially cylindrical and are substantially concentric to each other and substantially concentric to wall portion 110 and to wall portion 106. The inner surface of section 121 and the outer surface of wall portion 106 are connected by a series of eighteen radial webs 121*a*. Adjacent radial web pairs define intermediate clearance openings 121*b*. (See FIGS. 10 and 10A) The cylindrical space 122 between wall portion 106 and section 121 which is partitioned into clearance openings 121*b* provides the oil fill path from open edge 123 to the interior of the housing 100. The centered aperture 103 is closed once the cone-stack subassembly is assembled into the housing as part of the centrifuge and thus a flow path is needed for the oil added at open end 123 in order to reach the interior of the housing. This oil flow path is provided in part by the eighteen openings 121*b* of the cylindrical clearance space 122 as described above, and in part by open regions 109*c* and 109*d*.

Figure 12A:
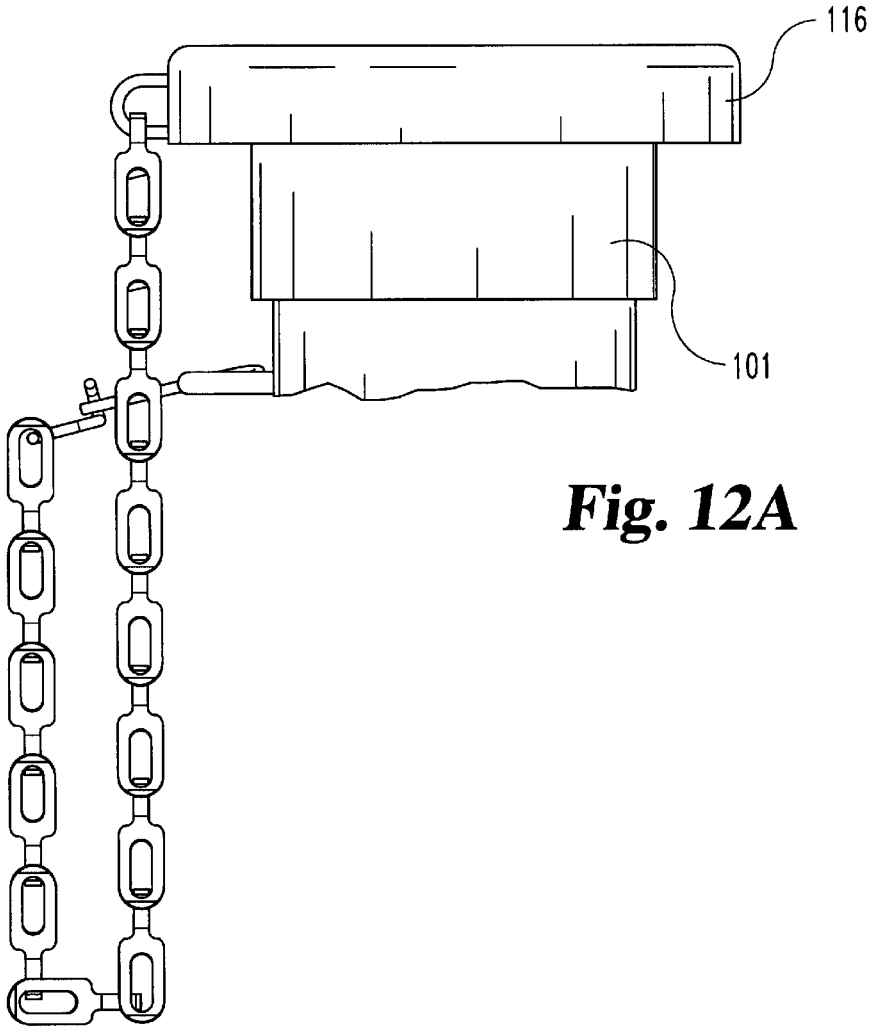
FIG. 12A is a side elevational view of a closing cap as assembled to the oil fill port of the FIG. 8 housing.
Figure 13:
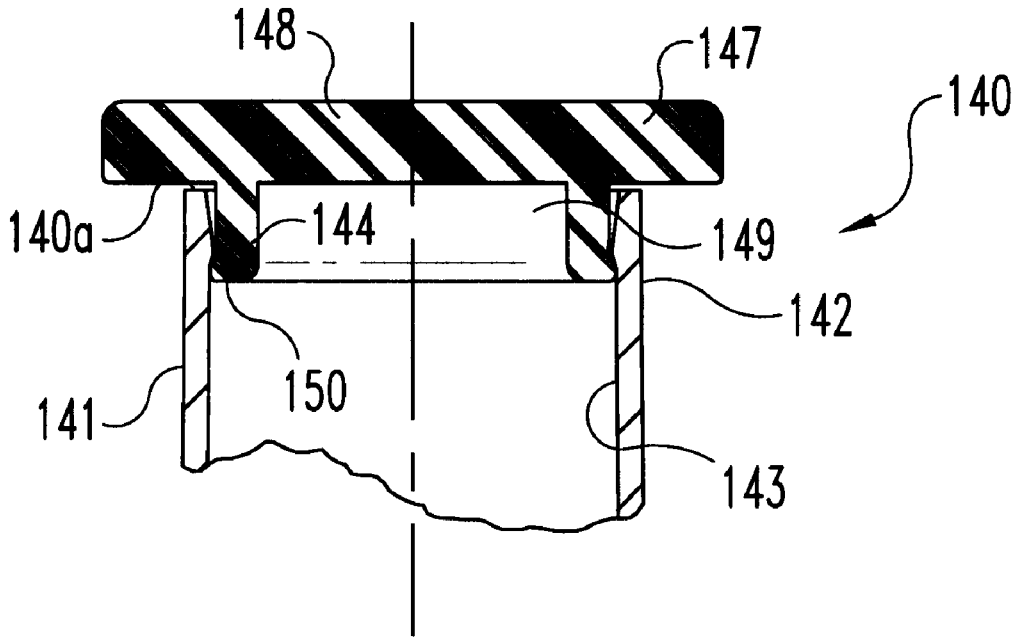
FIG. 13 is a partial, side elevational view, in full section, of an alternative closing cap arrangement for the FIG. 3 and FIG. 8 oil fill ports.

As an alternative to the bayonet connection for closing cap 116, it is envisioned that a wall portion can be constructed and arranged with internal threads for use with a cap having an insert portion with external threads. The final visual appearance, whether using a bayonet-type connection or threaded engagement, would look much the same as illustrated in FIG. 12A. A further connection options using a flexible rubber closing plug is illustrated in FIG. 13.

The unitary, molded plastic (or cast metal) construction of housing 100 is virtually identical to that of housing 50, including the ribbed base portion 128 and including the positioning of the oil fill port 101 on axial centerline 127. The oil fill port 101 extends upwardly in an axial direction which is substantially parallel to the longitudinal and centerline axis of housing 100 which is also the axis of rotation for the centrifuge. All of the characteristics of oil fill port 101 with regard to its location and orientation are identical to oil fill port 57, except that oil fill port 101 is shifted along the diametrical centerline plane from a side location (see FIGS. 3 and 4) to the centered and concentric location as illustrated in FIG. 9. Otherwise, the longitudinal centerline of the oil fill port 101 is parallel and coplanar, in this case concentric, with the longitudinal centerline axis of the housing and of the centered aperture 103.

Referring now to FIG. 13, an alternative for closing the open end of either oil fill port 57 (see FIG. 4) or oil fill port 101 (see FIG. 9) is illustrated. This same style of conduit is illustrated in FIG. 4A, as described in connection with FIGS. 5 and 6. In FIG. 13, the reference to oil fill port 140 is intended to be a generic representation corresponding to the off-center design of oil fill port 57 (and 57') and the concentric design of oil fill port 101, even though the off-center design is used as the corresponding style for FIG. 13.

The conduit 141 which creates oil fill port 140 has a substantially cylindrical outer wall surface 142. The inner surface 143 includes an inwardly protruding lip 144. Flexible rubber stopper (i.e., closing cap) 147 is used to seal closed the open end 140*a* of oil fill port 140. The enlarged head 148 of stopper 147 extends beyond surface 142 so as to axially seal down on the upper edge of end 140*a*. The insert portion 149 includes an enlarged end 150 which is constructed and arranged to snap beneath lip 144 so as to axially hold the stopper 147 in position and to provide axial and radial sealing. The resilient nature of stopper 147, due to its construction out of a flexible rubber material, enables the enlarged end to be located beneath lip 144 by simply pushing the insert portion fully into conduit 141.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A centrifuge for processing a flow of oil, said centrifuge comprising:

a mounting base defining a drain passageway;

a unitary housing connected to said mounting base and including a main body and an integral oil fill port, said main body including a lower edge arranged with a plurality of spaced-apart strengthening ribs;

centrifugal separation means for separating particulate matter from said flow of oil, said centrifugal separation means being positioned in and cooperating with said unitary housing;

said unitary housing defining a centered aperture for use in assembly of a cone-stack subassembly and connection of said centrifuge housing to said mounting base;

said integral oil fill port and said centered aperture being concentric to each other;

said unitary housing including an inner wall positioned between said integral oil fill port and said centered aperture; and said inner wall and an outer wall of said centered aperture being connected by spaced-apart webs which define clearance openings for the flow of oil into said unitary housing via said integral oil fill port.

2. A self-driven, cone-stack centrifuge for use in an engine for processing a flow of oil, said cone-stack centrifuge comprising:

a mounting base defining a drain passageway and including a support plate which is constructed and arranged to be attached to said engine;

a unitary centrifuge housing connected to said mounting base, said centrifuge housing including a main body and an integral oil fill port;

a cone-stack subassembly for separating particulate matter from said flow of oil, said cone-stack subassembly being positioned in and cooperating with said unitary housing;

said centrifuge housing defining a centered aperture for use in assembly of said cone-stack subassembly and connection of said centrifuge housing to said mounting base;

said integral oil fill port and said centered aperture being concentric to each other;

said centrifuge housing including a top portion and said integral oil fill port being integral with said top portion;

said centrifuge housing including an inner wall positioned between said integral oil fill port and said centered aperture; and said inner wall and an outer wall of said centered aperture being connected by spaced-apart webs which define clearance openings for the flow of oil into said centrifuge housing via said integral oil fill port.

3. A centrifuge for processing a flow of oil, said centrifuge comprising:

a mounting base defining a drain passageway;

a unitary housing connected to said mounting base and including a main body and an integral oil fill port, said main body including a lower edge arranged with a plurality of spaced-apart strengthening ribs;

centrifugal separation means including a cone-stack subassembly for separating particulate matter from said flow of oil, said centrifugal separation means being positioned in and cooperating with said unitary housing;

said unitary housing defining a centered aperture for use in the assembly of said cone-stack subassembly and the connection of said unitary housing to said mounting base;

said integral oil fill port and said centered aperture being concentric to each other;

said unitary housing including an inner wall positioned between said integral oil fill port and said centered aperture; and said inner wall and said outer wall of said centered aperture being connected by spaced-apart webs which define clearance openings for the flow of oil into said unitary housing via said integral oil fill port.

4. A self-driven, cone-stack centrifuge for use in an engine for processing a flow of oil, said cone-stack centrifuge comprising:

a mounting base defining a drain passageway and including a support plate which is constructed and arranged to be attached to said engine;

a unitary centrifuge housing connected to said mounting base, said centrifuge housing including a main body and an integral oil fill port;

a cone-stack subassembly for separating particulate matter from said flow of oil, said cone-stack subassembly being positioned in and cooperating with said unitary housing;

said centrifuge being constructed and arranged with an axis of rotation and said oil fill port having a longitudinal axis which is substantially parallel to said axis of rotation;

said unitary housing being injection molded out of plastic;

said main body including a lower edge arranged with a plurality of spaced-apart strengthening ribs;

said centrifuge housing defining a centered aperture for use in assembly of said cone-stack subassembly and connection of said centrifuge housing to said mounting base;

said integral oil fill port and said centered aperture being concentric to each other;

said centrifuge housing including a top portion and said integral oil fill port being integral with said top portion;

said centrifuge housing including an inner wall positioned between said integral fill port and said centered aperture; and said inner wall and an outer wall of said centered aperture being connected by spaced-apart webs which define clearance openings for the flow of oil into said centrifuge housing via said integral oil fill port.

* * * * *